US009739113B2

(12) United States Patent
Patel

(10) Patent No.: US 9,739,113 B2
(45) Date of Patent: Aug. 22, 2017

(54) COMPLETIONS FLUID LOSS CONTROL SYSTEM

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 844 days.

(21) Appl. No.: 13/741,996

(22) Filed: Jan. 15, 2013

(65) Prior Publication Data

US 2013/0180735 A1 Jul. 18, 2013

Related U.S. Application Data

(60) Provisional application No. 61/586,967, filed on Jan. 16, 2012, provisional application No. 61/586,959, filed on Jan. 16, 2012.

(51) Int. Cl.

| | |
|---|---|
| ***E21B 33/13*** | (2006.01) |
| ***E21B 33/126*** | (2006.01) |
| ***E21B 43/12*** | (2006.01) |
| ***E21B 43/10*** | (2006.01) |

(52) U.S. Cl.

CPC ..... *E21B 33/126* (2013.01); *E21B 33/13* (2013.01); *E21B 43/10* (2013.01); *E21B 43/12* (2013.01)

(58) Field of Classification Search

CPC ..... E21B 33/126; E21B 43/12; E21B 43/10

See application file for complete search history.

(56) References Cited

U.S. PATENT DOCUMENTS

| | | | | |
|---|---|---|---|---|
| 6,607,031 | B2 * | 8/2003 | Lynde et al. | 166/99 |
| 6,651,744 | B1 | 11/2003 | Crawford | |
| 7,735,555 | B2 * | 6/2010 | Patel et al. | 166/278 |
| 7,775,275 | B2 * | 8/2010 | Patel | 166/263 |
| 2009/0078407 | A1 | 3/2009 | Carro | |
| 2010/0163235 | A1 * | 7/2010 | Mootoo et al. | 166/278 |
| 2010/0175894 | A1 | 7/2010 | Debard et al. | |
| 2011/0139465 | A1 | 6/2011 | Tibbles et al. | |
| 2012/0255738 | A1 * | 10/2012 | Lauderdale et al. | 166/373 |

OTHER PUBLICATIONS

International Search Report and Written Opinion mailed on May 8, 2013 for International Patent Application No. PCT/US2013/021671, filed on Jan. 16, 2013, 10 pages.

Russian Appl. No. 2014133528, First Office Action dated Jun. 4, 2015, 6 pgs.

* cited by examiner

*Primary Examiner* — Nicole Coy

(57) ABSTRACT

A completions fluid loss control system for incorporation into upper completion hardware. The system allows for the avoidance of a dedicated intermediate completion installation in advance of upper completion delivery to a lower completion at a formation interface. The system includes a unique cup packer and flow regulation arrangement such that annular fluid thereabove may be isolated away from space below the system while at the same time allowing annular fluid therebelow to bypass the system. As such, the upper completion may be advanced toward the installed lower completion while maintaining well control at the noted formation interface.

13 Claims, 5 Drawing Sheets

COMPLETIONS FLUID LOSS CONTROL SYSTEM

PRIORITY CLAIM/CROSS REFERENCE TO RELATED APPLICATION(S)

This Patent Document claims priority under 35 U.S.C. §119 to U.S. Provisional App. Ser. Nos. 61/586,959 and 61/586,967, entitled "Completion System with ESP Run" and "Completion System for Subsea ESP Run" respectively, both filed on Jan. 16, 2012 and incorporated herein by reference in their entireties.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

In terms of architecture, the terminal end of a cased well often extends into an open-hole section. Thus, completions hardware may be fairly complex and of uniquely configured parts, depending on the particular location and function to be served. For example, in addition to the noted casing, the hardware may include gravel packing, sleeves, screens and other equipment particularly suited for installation in the open-hole section at the end of the well. However, hardware supporting zonal or formation isolation may be located above the open-hole section. Further, certain features such as chemical injection lines may traverse both cased and open-hole well regions. Once more, such complex architecture may need to remain flexible enough in terms of design and installation sequence so as to account for perforating, fracturing, gravel packing and a host of other applications that may be employed in completing the well.

With the above factors in mind, the sequence of hardware installation, following drilling and casing of the well, may begin with gravel packing directed at the open-hole productive region of the well. In terms of hardware delivery for a corresponding lower completion, this may include the installation of screen equipment, a gravel pack packer, a frac sleeve and other features at this productive interface. The result is a cased well that now terminates at a lower completion having at least a temporary degree of fluid control.

This temporary fluid control may consist of no more than employing frac sleeves closed over the formation interface at the lower completion. Thus, an intermediate completion, targeting a more secure form of well control may be installed. That is, once the lower completion is installed, a second trip into the well dedicated to the installation of a formation isolation valve with sealing architecture running to the lower completion may be installed. Thus, a more reliable and permanent form of control may be provided. Once more, this second intermediate completion may include the delivery of a polished bore receptacle, or "PBR", assembly. As such, a receiving platform is provided for subsequent installation of production tubing and other hardware of the upper completion.

The intermediate completion is delivered by way of work string that not only is used for installation, but also achieves proper isolation during delivery. For example, the string delivers the intermediate completion with the formation isolation valve open, lands out and is then withdrawn in a manner that closes the valve before the string leaves sealed engagement with the PBR there above. As a result, fluid control over the lower completion is tightly maintained from the moment of installation of the intermediate completion.

With the intermediate completion fully installed and a means of permanent control now available over the lower completion, the upper completion may be installed as noted above. That is, a third trip into the well for delivery of and installation of production tubing, internal electric submersible pump (ESP), intelligent completion consisting of flow control valves and other equipment may now safely proceed. This equipment may be safely landed out at the PBR and installed without undue concern over maintaining fluid control over the underlying lower completion.

Unfortunately, the installation of the intermediate completion in order to provide a secure and reliable platform for the subsequent upper completion installation is an extremely costly undertaking. For example, depending on the overall depth of the well, the intermediate installation may take two days or more and consume millions of dollars in terms of equipment, rig-up and other dedicated time-related costs. Furthermore, the presence of an intermediate completion means that the number of equipment mating applications is doubled. That is, rather than simply mating an upper completion to a lower completion, an intermediate completion is mated to the lower followed by the mating of the upper completion to the intermediate. This doesn't just add time, it doubles the likelihood of mismatching or damaging the completions hardware during installation.

The possibility of loss of well control may be dramatically expensive if not catastrophic. Thus, in spite of the drawbacks associated with the intermediate completion as noted above, it remains preferable to have one installed. That is, as opposed to sole reliance on less secure well control features, such as closed sleeves of the lower completion, the installation of an intermediate completion generally remains the best available option for attaining a reliably installed upper completion.

SUMMARY

A fluid loss control system is detailed herein that is configured for use with completion hardware, namely to aid in completion installation in a well. The system includes a tubular mandrel for advancement through the well for ultimate delivery to a location therein. A cup packer assembly is disposed about the mandrel for sealing an annular space of the well. However, a flow regulation mechanism is coupled to an underside of this assembly such that annular fluid is allowed to bypass the assembly during the advancement, yet at the same time close off flow upon delivery of the mandrel to the location.

DETAILED DESCRIPTION

Embodiments are described with reference to certain completions hardware and manners of installation. In particular, lower and upper completion assemblies are detailed that are configured for installation and without the requirement of an intervening intermediate assembly for maintenance of fluid loss control. Rather, a unique fluid loss control system is incorporated into the upper completion so as to allow maintenance of control during installation. While such embodiments are detailed herein in conjunction with certain hardware such as electric submersible pumps and circulation valves, a variety of other hardware installations such as intelligent completion, slotted liner, and screen may take advantage of the unique control system. For example, the tubular mandrel of the upper completion may also be employed for delivering a slotted liner. Further, such hardware may be installed in conjunction with the installation of the upper completion or via separate conveyance such as coiled tubing. Regardless, a fluid loss control system is provided of unique cup packer and flow regulation features that allow for avoidance a costly intermediate completion assembly without sacrifice to reliable maintenance over flow control.

Figure 1:
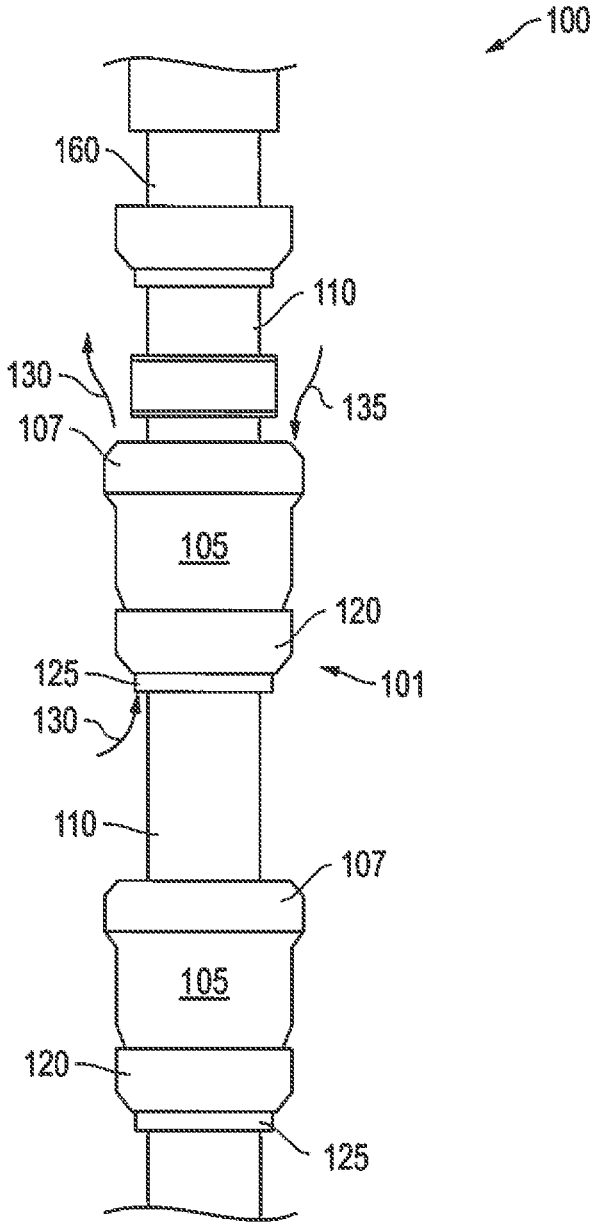
FIG. 1 is a side view of an embodiment of a fluid loss control system for use in upper completion installation in a well.

Referring now to FIG. 1, a side view of an embodiment of a fluid loss control system 101 is shown which is incorporated into an upper completion 100. As with many conventional completions, the upper completion 100 is constructed of a production tubular 110 and packer 160. However, in this case, a system 101 is provided which allows for installation without the prerequisite placement of an intermediate completion to ensure fluid control. Indeed, as described further below, the system 101 allows for the entire upper completion 100 to be advanced through a well 280 for installation even though no intermediate completion is present (see also FIG. 2). That is, the safeguards of fluid loss control measures are incorporated into the upper completion itself 100 via the noted system 101.

Continuing with reference to FIG. 1, skipping the dedicated hardware and trip into the well for the intermediate completion is possible due to the nature of the fluid loss control system 101. More specifically, with added reference to FIG. 2, the system 101 includes one or more cup packers 105 which are sized to form a sealing engagement with a well wall (e.g. casing 285) as the upper completion 100 is advanced to a location for installation. The cup packer 105 is a preferred embodiment for providing seal in the annular cavity between casing and tubing. However, the sealing element is not limited to cup packer only, any compliant sealing element that provide seal in the annular cavity between casing and tubing can be used in place of cup packer 105. Thus, potentially heavier uphole fluid 135 above the system 101 is sealably held from migrating down to the formation 295 through lower completion 400 during the installation of the upper completion 100.

Figure 4A:
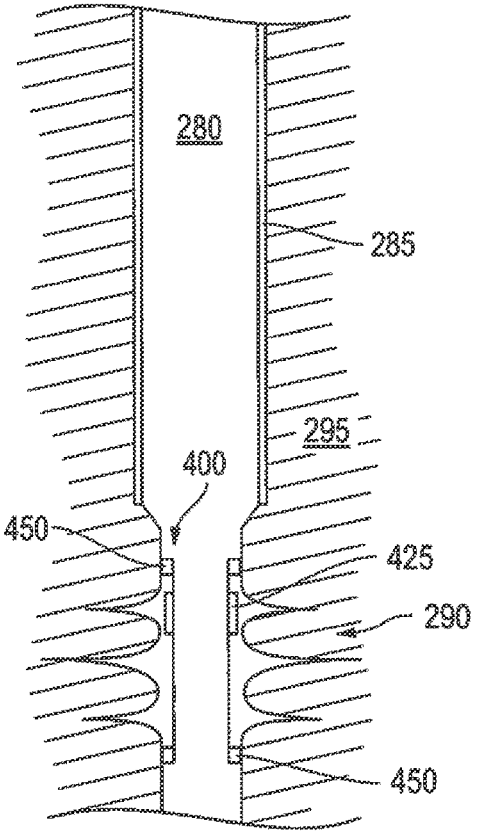
FIG. 4A is an enlarged view of a portion of the well of FIG. 2, revealing installation of a lower completion.

That is, hardware of the lower completion 400, such as the frac pack sleeve 450 of FIG. 4A, or a mechanical fluid loss control device, such as Formation Isolation Valve, is opened for insertion of the lower portion of the upper completion inside the lower completion. Thus, the potential exists for heavier fluid 135 in the well bore to be in communication with the formation 295 which may result in a well control situation. However, in the embodiments herein, the formation fluid is prevented from flowing uphole and resulting in a well blow out. Notably, this is achieved without the requirement of an intermediate completion to ensure such control. That is, the upper completion 100 itself is outfitted with the fluid loss control system 101.

In addition to preventing uphole fluids 135 from migrating downhole to more susceptible areas of concern, the fluid loss control system 101 is also tailored to intentionally allow uphole migration of downhole fluids 130. That is, as the upper completion 100 is advanced downhole, rather than being forced downhole, these fluids 130 are allowed to bypass the cup packers 105 of the system 101. In this manner, the forces on such fluids 130 as the uphole completion 100 advances are largely negated. Accordingly, fluid forces on the lower completion 400 as a result of the advancing upper completion 100 are substantially eliminated (see FIG. 2).

The bypass of downhole fluids 130 as described above is achieved by way of a fluid loss control device 120 which is incorporated into a thimble at the base of the cup packers 120. More specifically, as detailed further below with reference to FIGS. 3A and 3B, bypass channels 330 are provided through the device 120 to allow uphole migration of fluids 130. Alternatively, however, access through these channels 330 is closed off to uphole fluids 135 that may be migrating in a downhole direction (see regulator valve 300 of FIGS. 3A and 3B).

Figure 2:
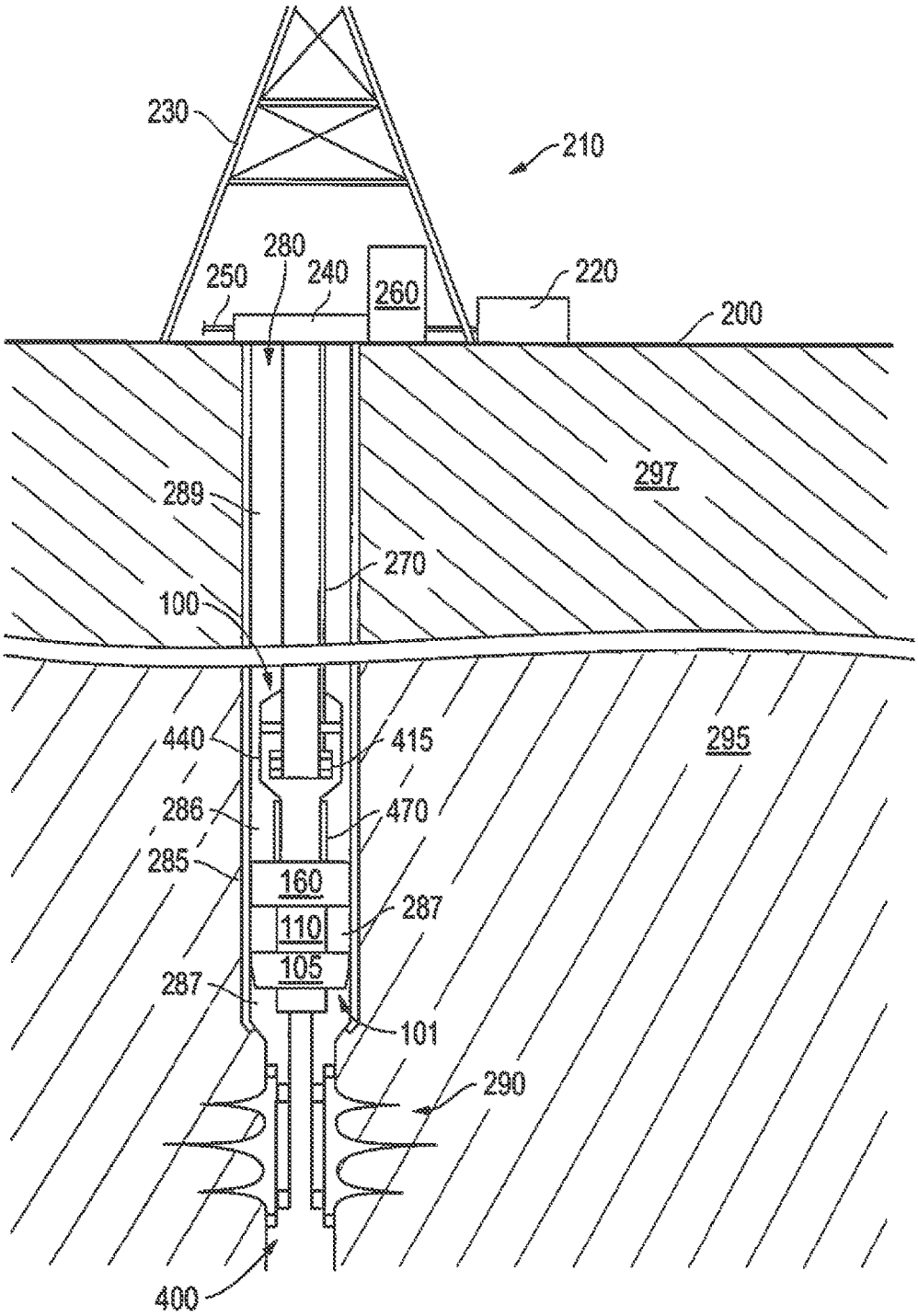
FIG. 2 is an overview depiction of an oilfield with a well accommodating the system and upper completion of FIG. 1, operably coupled to a lower completion.

Referring now to FIG. 2, an overview of an oilfield 200 is depicted with a well 280 accommodating the system 101 and upper completion 100 of FIG. 1. More specifically, the upper completion 100 is operably coupled to the lower completion 400. Thus, a fully installed completions hardware is provided for sake of producing and regulating hydrocarbon uptake from a production region 290 of a surrounding formation 295.

As indicated above, the completions hardware is fully installed. In this particular embodiment, this means that the production packer 160 above the fluid loss control system 101 has been set. Thus, the sealable nature of the underlying cup packer 105 and overall system 101 has completed the intermediate function of fluid loss control. Now, a substantially permanent mechanism, the packer 160 is available to maintain such control for the duration of well operations. With respect to the annular space 289, this means that an uphole portion 286 thereof is sealably isolated from a downhole portion 287 thereof by the packer 160. The more temporary cup packer 105 and system 101 no longer need play a role in maintaining such control.

Continuing with reference to FIG. 2, the lower completion 400 is now adequately safeguarded for functioning on over the substantial life of the well 280 in regulating the uptake of production from the noted region 290. Production through the lower completion 400 may be aided by a variety of equipment incorporated into the upper completion 100. In the embodiment shown, this may include an electronic submersible pump 415 (ESP) and shroud 440 which are fluidly mated with the production tubing 110. Thus, a positive aid to the uptake of production fluids to surface may be provided. Further, in other embodiments, a variety of additional equipment and features may be incorporated into the upper completion 100. This may include a circulating valve, chemical injection hardware, Flow Control valves or additional valves as detailed further below. With regard to the valves in particular, they may now be provided by incorporation into the upper completion 100 and need not be separately installed via a costly and dedicated time-consuming trip into the well 280.

With the completion hardware fully installed production may be regulated through surface equipment 210 at the oilfield 200. For example, in the embodiment shown, a communication line 270 is provided between a control unit 260 adjacent the well head 240 at surface 200 and the ESP 415. Of course, a host of additional communication or injection lines may also be provided. For example, sand face monitoring and control lines may be run to the lower completion 400. Further, in circumstances such as these, where lines are mated between the upper 100 and lower 400 completions, the effort and precision of an added intermediate mating is eliminated due to the elimination of the intermediate completion. Thus, the likelihood of a mismatched unreliable mated connection is reduced in addition to the overall savings of time and equipment expense.

Continuing with reference to FIG. 2, the well 280 is defined by a casing 285 traversing various formation layers 297, 295 and reaching extensive depths, perhaps ten thousand feet or more. Thus, time savings in avoidance of the installation of an intermediate completion may amount to days. Once more, this means that the uphole portion 286 of the annular space 289 may be quite voluminous overall. As such, the set packer 160 may be of significant value in retaining uphole fluids away from the downhole completion 400. This may be particularly the case where the packer 160 is set followed by the circulation in of heavier uphole fluids in the uphole portion 286 of the space 289. Thus, in addition to a rig 230, production line 250 and other conventional surface equipment 210, a surface pump 220 may be provided to aid in such replacement circulation of fluids 135 (see FIG. 1).

Figure 3A:
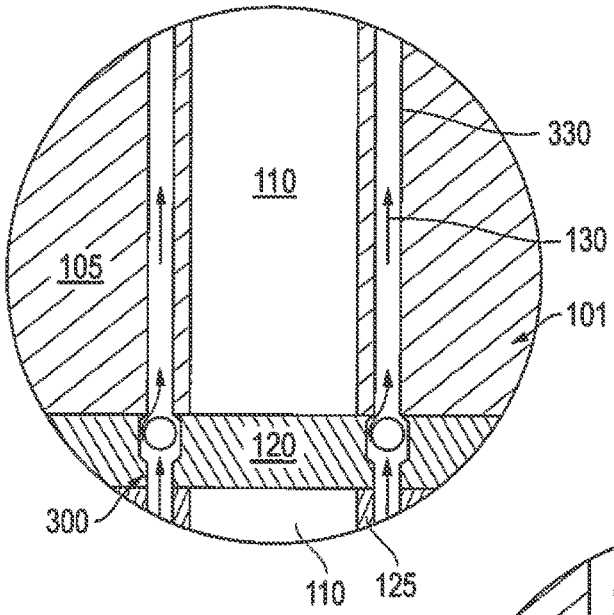
FIG. 3A is an enlarged view of a cup packer and flow regulation mechanism assembly of the system of FIG. 1 during installation thereof.
Figure 3B:
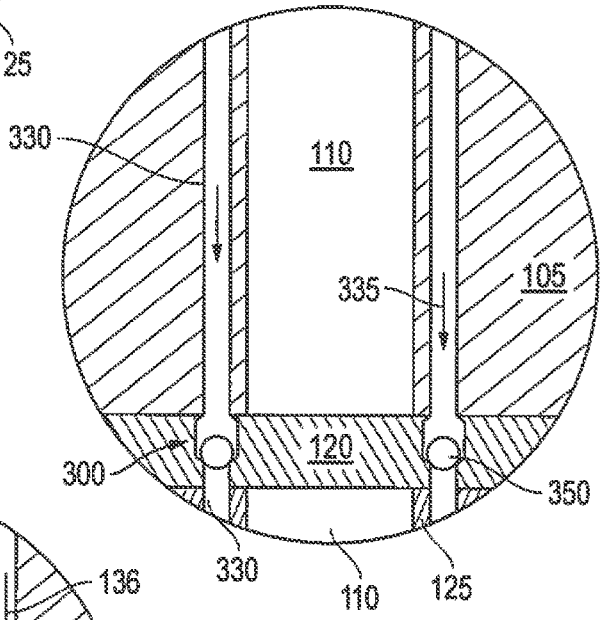
FIG. 3B is an enlarged view of the cup packer and flow regulation mechanism of the assembly of FIG. 1 following installation.
Figure 3C:
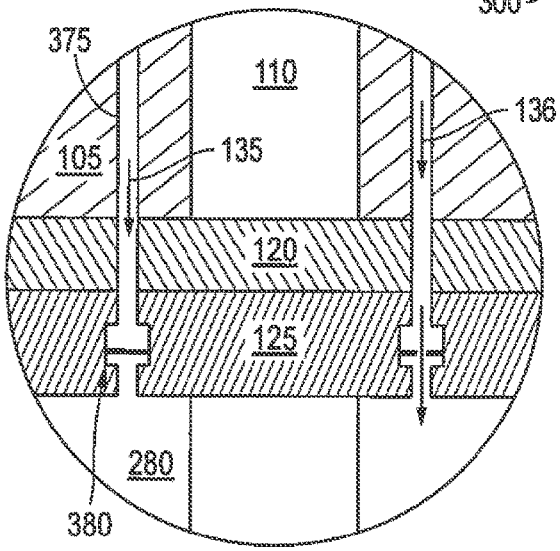
FIG. 3C is an enlarged view of the cup packer and a flow regulation override mechanism of the assembly of FIG. 1 for removal of the system from the well.

Referring now to FIGS. 3A-3C, the inter-workings of the fluid loss control system 101 are shown. More specifically, with added reference to FIGS. 1-2, FIG. 3A reveals an enlarged view of a cup packer 105 and underlying regulator valve 300 during installation of the upper completion 100 of FIGS. 1 and 2. FIG. 3A on the other hand reveals these same features 105, 300 upon delivery of the upper completion 100, at a time when the packer 160 thereabove is set. Notably, as detailed further below, flow up through bypass channels 330 is allowed during downhole advancement of the upper completion 100. However, upon installation, flow is terminated. Further, in the event that flow is necessary following installation, for example to remove the upper completion 100, flow may be allowed through alternate channels 375 as shown in FIG. 3C.

With particular reference to FIG. 3A, with added reference to FIG. 2, the noted bypass channels 330 are shown allowing downhole fluid 130 to pass up through the body of the cup packer 105 during downhole advancement through the well 280. Thus, such fluids 130 are not compressibly or forcibly directed toward the lower completion 400 to any consequential degree. More specifically, the regulator valves 300 controlling access to the channels 330 are naturally opened with the upflow of such fluids 130.

On the other hand, continuing with added reference to FIG. 2, once the upper completion 100 is landed out, and uphole flow relative the cup packer 105 ceases, the same valves 300 may return to a naturally closed position as shown in FIG. 3B. In fact, in some circumstances, setting of the production packer 160 or other applications above the system 101 may increase uphole pressure or otherwise drive uphole fluids 135 in a downhole direction. Nevertheless, the regulation valve 300 with internal ball 350 remains at its closed seated position to prevent such fluids 135 from reaching the lower completion 400.

Of course, continuing with added reference to FIG. 2, circumstances may arise in which removal of the upper completion 100, for example in the course of a workover, is required. Thus, as depicted in FIG. 3C, an override assembly 125 is provided. More specifically, this assembly 125 is also located adjacent the cup packer 105 to allow for bypass therethrough. The override assembly 125 includes a suitable override mechanism 380 that may be triggered to allow access to alternate channels 375 which also traverse the packer 105.

In the embodiment shown, the override mechanism 380 is a rupture disk device that may be interventionally actuated, pressure actuated or otherwise triggered from surface via conventional means. Once this takes place, uphole fluids 135 may be allowed to flow past the cup packer 105 as the upper completion 100 is removed from the well 280. Thus, the column of fluid 135 above the cup packer 105 fails to present a substantial obstacle to upper completion removal. However, in other embodiments, the override mechanism 380 may be more directly integrated with the regulation valve 300 of FIGS. 3A-3B so as to disable the valve 300 and allow access to the original bypass channels 330. Either way, the upper completion 100 may now effectively be removed or other actions undertaken which may benefit from available cup packer bypass.

Figure 4B:
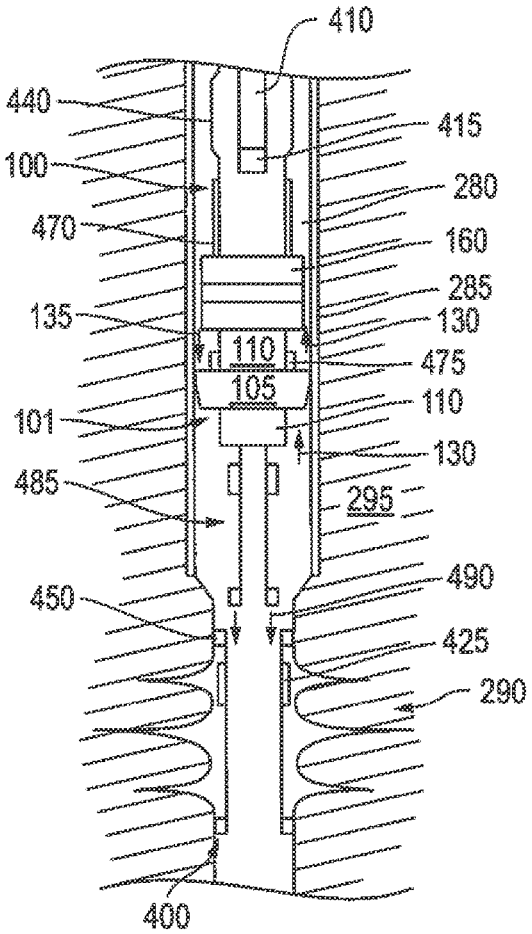
FIG. 4B is an enlarged view of the portion of the well of FIG. 4A, revealing installation of the system and upper completion of FIG. 2 relative the lower completion.

Referring now to FIGS. 4A-4B, enlarged views of a portion of the well 280 are depicted with completions hardware being installed therein. More specifically, FIG. 4A depicts a lower completion 400 installed followed by the mating installation of an upper completion 100 thereto in the depiction of FIG. 4B. In these views, the advantageous absence of an installation step dedicated to an intermediate completion may be more fully appreciated.

With specific reference to FIG. 4A, the lower completion 400 is shown at the interface between a well 280 and a production region 290 of a formation 295. Thus, as opposed to the structural support afforded by a casing 285, this portion of the well 280 is defined by comparatively less robust or more permeable hardware. For example, in the embodiment shown, a farc pack assembly including gravel pack packers 450 is utilized. Once more, a frac sleeve 425 is shown which may be employed to govern or close off fluid access between the well 280 and the production region 290.

A temporary measure such as the closure of a frac sleeve 425 may be adequate for initially isolating the production region 290 from the well 280 (or even vice versa). However, in light of the comparatively delicate nature of the interface as noted above and the forthcoming substantial installation of the upper completion 100, added measures may be taken beyond frac sleeve closure 425. Conventionally, this may have included the massive undertaking of a dedicated intermediate completion installation as noted above. However, as described herein and further below, such measures may be addressed based on the makeup of the upper completion 100 itself With specific reference now to FIG. 4B, the upper completion 100 is outfitted with the above detailed fluid loss control system 101. Thus, as it proceeds into engagement with the lower completion 400, a cup packer 105 allows downhole fluids 130 to bypass the system 101 as opposed to being compressed or directed toward the lower completion 400. At the same time, the sealing nature of this packer 105 prevents uphole fluids 135 from migrating downhole beyond the system 101.

Continuing with reference to FIG. 4B, the installation of the upper completion 100 includes directing an isolating seal assembly 485 down into engagement with the noted lower completion 400 (see arrows 490). Thus a more stabilized controlled path to the production tubing 110 is provided. Further, a barrier valve 475 may be located above the system 101 for governing access through the tubing 110. Additionally, a polished bore receptacle 470 (PBR) may be located above the barrier valve 475 so that interventional access to the barrier valve 475 or lower completion 400 may be controllably attained. For example, coiled tubing 410, a shifting tool or other interventional devices may be utilized for attaining access to the lower completion 400. Though, in the embodiment shown, coiled tubing 410 is utilized to delivering the ESP 415.

Once the upper completion 100 is fully engaged with the lower completion 400, conventional triggering may be utilized to set the packer 160 and fully isolate the annular space therebelow to the lower completion 400. At this time, the fluid loss system 101 may have completed its primary function, the lower completion 400 now being adequately isolated for ongoing well operations.

Figure 5:
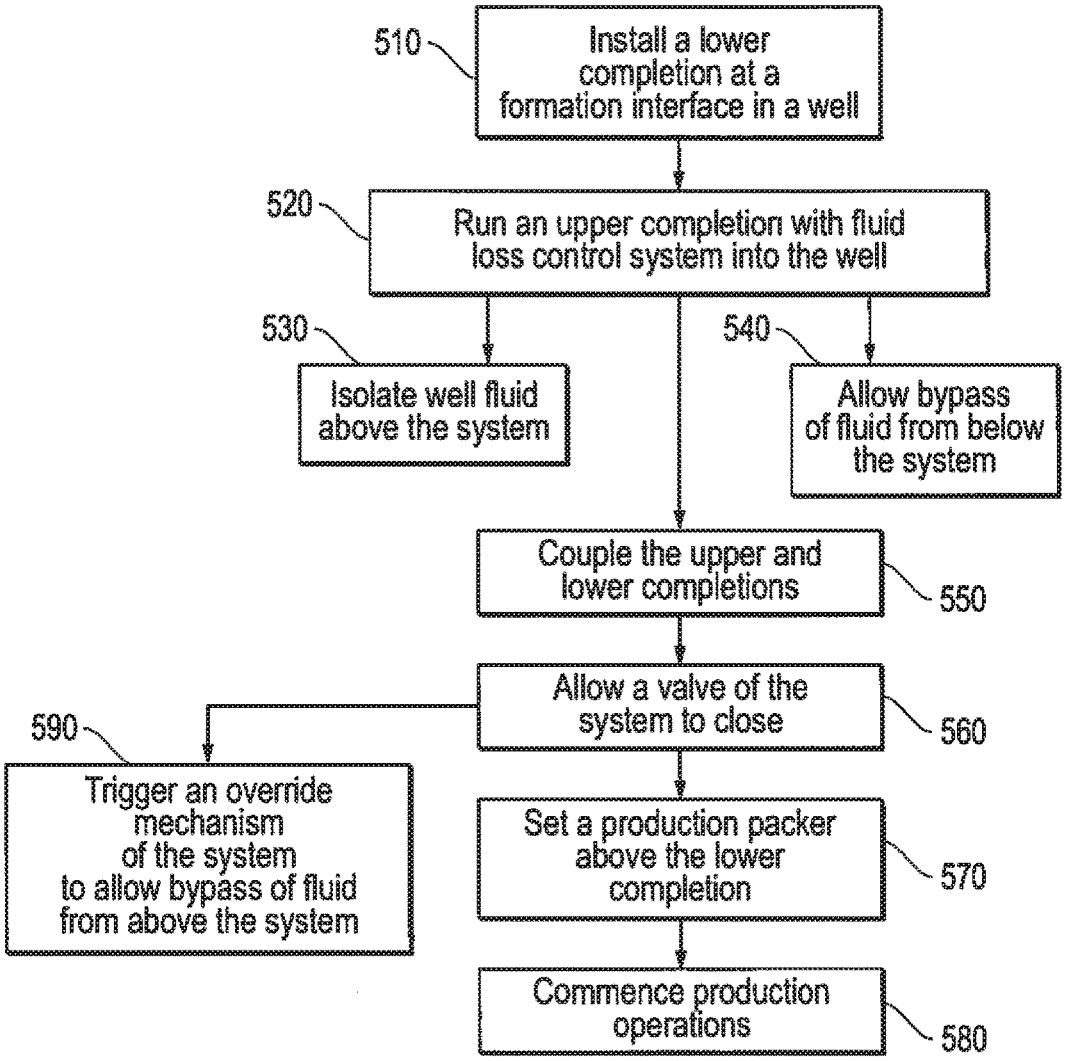
FIG. 5 is a flow-chart summarizing an embodiment of installing completions hardware with the aid of a fluid loss control system.

Referring now to FIG. 5, a flow-chart summarizing an embodiment of installing completions hardware with the aid of a fluid loss control system is depicted. As indicated at 510, the lower completion may be installed immediately followed by running of the upper completion into the well (see 520). However, as the upper completion is run into the well, bypass of fluid from below a fluid loss control system of the upper completion may be allowed as indicated at 540. At the same time, as shown at 530, fluid above the system may remain isolated thereby.

Once the completions are coupled or mated together as indicated at 550, a valve of the system may be closed as indicated at 560 to complete an annularly sealed isolation. In circumstances where later removal of the upper completion is required, the system may also be outfitted with an override mechanism as shown at 590. Thus, a bypass of fluid from above the system may be allowed so as to allow for a practical raising and removal of the upper completion.

Continuing with reference to FIG. 5, a production packer is set once the initial system-based isolation is achieved (see 570). Further, once fully installed, production operations may commence as indicated at 580. Such operations may be preceded by circulating in packer fluid, running a preliminary coiled tubing or shifting tool intervention, or any number of other set-up measures. Regardless, a more permanent isolation has been achieved without the costly and time consuming measure of intermediate completion installation.

Embodiments described hereinabove include completion hardware that is installed in a secure and reliable manner in terms of maintaining well control. This is achieved in a manner that eliminates the need for an intermediate completion platform in advance of upper completion installation. As a result, a significant amount of expense and time may be saved. Additionally, the risk of misaligned or otherwise deficient coupling of completion hardware is reduced.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, different completions architectures utilizing cement casing, multiple cables, real-time monitoring and a variety of other hardware features may take advantage of embodiments of a fluid loss control system as detailed herein. Regardless, the foregoing description should not be read as pertaining only to the precise structures described and shown in the accompanying drawings, but rather should be read as consistent with and as support for the following claims, which are to have their fullest and fairest scope.

I claim:

1. An upper completion system comprising:

a tubular mandrel for advancement through a well for delivery at a location therein; and a fluid loss control assembly about the tubular mandrel with a cup packer for sealing annular space of the well relative to fluid thereabove and a flow regulation mechanism comprising a regulator valve in fluid communication with a bypass channel routed along the tubular mandrel between the tubular mandrel and an exterior of the cup packer, the regulator valve having an element which moves to allow annular fluid therebelow to bypass the fluid loss control assembly during the advancement and to block the bypass of fluid after the location in the well is reached, wherein the tubular mandrel accommodates one of an electric submersible pump, a slotted liner, and an intelligent completion.

2. The system of claim 1 wherein said tubular mandrel is production tubing.

3. The system of claim 2 wherein said production tubing is fluidly coupled to one of a barrier valve and a polished bore receptacle of the upper completion.

4. The system of claim 2 further comprising a production packer about said production tubing above said fluid loss control assembly.

5. The system of claim 4 wherein said electric submersible pump is coupled to one of said tubing and a coiled tubing conveyance through said tubing.

6. The system of claim 1 further comprising an isolating seal assembly for coupling to an installed lower completion in the well.

7. The system of claim 6 further comprising a line of the upper completion coupled to a line of the lower completion at a location of the coupling.

8. The system of claim 6 wherein the lower completion includes a frac pack assembly comprising:

a gravel pack at a formation interface of the well; and a frac sleeve to govern fluid communication between the formation and the well.

9. A method comprising:

installing a lower completion at a formation interface in a well;

running an upper completion into the well and into engagement with the lower completion without an intermediate completion;

providing the upper completion with a fluid loss control system having a regulator valve;

employing the fluid loss control system for isolating well fluid in an annulus thereabove and to allow a bypassing of fluid from therebelow during the running; and shifting the regulator valve after the running to prevent flow of fluid from the annulus down through the fluid loss control system.

10. The method of claim 9 wherein the fluid loss control system comprises a cup packer for the isolating with a flow regulation mechanism coupled thereto for the bypassing.

11. The method of claim 9 further comprising:

coupling the upper and lower completions;

setting a packer above the system to isolate the completions therebelow; and commencing well operations through the installed completions.

12. The method of claim 9 further comprising:

triggering an override mechanism of the system to allow bypass of fluid from thereabove; and removing the upper completion from the well.

13. The method of claim 12 wherein said triggering is a pressure actuated triggering of the override mechanism.

* * * * *